US007059595B2

(12) United States Patent
DaCunha et al.

(10) Patent No.: US 7,059,595 B2
(45) Date of Patent: Jun. 13, 2006

(54) METHOD AND APPARATUS FOR CONTROLLING FEEDING OF SHEETS

(75) Inventors: Steven J DaCunha, West Hartford, CT (US); Thomas P Nash, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 177 days.

(21) Appl. No.: 10/655,108

(22) Filed: Sep. 3, 2003

(65) Prior Publication Data

US 2005/0067767 A1 Mar. 31, 2005

(51) Int. Cl.
*B65H 3/12* (2006.01)

(52) U.S. Cl. ..... 271/96; 271/99; 271/226; 271/227

(58) Field of Classification Search ..... 271/226, 271/227, 229, 231, 91, 96, 97, 98, 99
See application file for complete search history.

(56) References Cited

U.S. PATENT DOCUMENTS 4,651,984 A * 3/1987 Emrich ..... 271/237
5,634,636 A * 6/1997 Jackson et al. ..... 271/225
5,921,544 A * 7/1999 Benedict ..... 271/226

* cited by examiner

*Primary Examiner*—Kathy Matecki
*Assistant Examiner*—Thomas Morrison
(74) *Attorney, Agent, or Firm*—Michael J. Cummings; Steven J. Shapiro; Angelo N. Chaclas

(57) ABSTRACT

A method and system for correcting the skew in mail-related items, which are caused to move by a driving mechanism in the mailing machine. The driving mechanism comprises at least two driving belts to drive the mail-related items by friction. A plurality of openings are provided on the driving belts so that air pressure can be applied to the mail-related items in order to change the friction between different driving belts and the mail-related items. The air pressure can be positive or negative and it can be applied on the left or right side, or on both sides but with different pressures.

12 Claims, 5 Drawing Sheets

METHOD AND APPARATUS FOR CONTROLLING FEEDING OF SHEETS

FIELD OF THE INVENTION

The present invention relates generally to mail inserters and, more particularly, to enclosure feeders in an inserter.

BACKGROUND OF THE INVENTION

Mail inserters have played a significant role among the labor saving devices available to businesses, which are engaged in the daily mailing of large numbers of pieces. Among the advantages of inserter usage has been the reduction in personnel required to process large quantities of outgoing mail. In a typical mail inserter, a plurality of enclosure feeders are used to release a plurality of enclosure materials or documents into the chassis of the inserter. The released documents are pushed downstream and collated into a stack. The stack is then inserted into an envelope in an insertion station. Inserters and enclosure feeders are known in the art. For example, Foster et al. (U.S. Pat. No. 4,418,515) discloses a mail inserter having a plurality of sloped trays, each of which carries a stack of documents, wherein one or more feed rollers are used to pick up a sheet of document at a time and release it into a chassis. Godlewski (U.S. Pat. No. 4,715,593) discloses a bottom stack feeder wherein a feeding mechanism having a plurality of feed rollers and pullout roller is used to pull out a sheet of stock items from the bottom of the stack in the feeding process.

The released documents are released from different feeders in the collation process. It is important that the released documents are fed evenly in that each document should be released onto the chassis with the leading edge substantially perpendicular to the releasing direction. However, the friction characteristics of the documents and the feeding mechanism sometimes render it difficult to achieve an even feeding. In an uneven feeding, the feed is skewed such that one side of the leading edge of the released document may move faster than the other side of the leading edge. Uneven feed may cause machine errors.

Thus, it is advantageous and desirable to provide a method and apparatus for controlling feeding of documents or enclosures in order to correct for the uneven feeding.

SUMMARY OF THE INVENTION

It is an objective to correct the skew of mail-related items in a mailing machine. The objective can be achieved by using a plurality of driving belts with openings to drive the items, and applying air pressure through the openings to change the friction force between a mail-related item and the driving belts if the skew exceeds predetermined value. According to the first aspect of the invention, a method for correcting movement of a plurality of items in a mailing machine, wherein the mailing machine has at least one driving mechanism for causing the items to move along a predetermined path. The method comprises the steps of:

detecting a skew of the items in the predetermined path, the skew being characterized such an item is positioned so that a leading edge of the item is tilted relative to the path and the leading edge in the first portion of the path is ahead of the leading edge in the second portion of the path, and correcting the skew if the skew exceeds a predetermined value by applying differing air pressure from the first or second parallel path portions to the skewed item.

monitoring the movement of the items for detecting a skew of the items in the predetermined path, and applying air pressure on the items for correcting the skew if the skew exceeds a predetermined value.

The mailing machine may comprise a plurality of enclosure feeders, each of which is used to release the mail-related items one at time, the method further comprising the step of disposing a plurality of sensors at each enclosure feeder for sensing the leading edge of an item released by said each enclosure feeder in order to detect the skew.

Preferably, the sensors are photosensors having light emitters and light detectors.

Preferably, each of the enclosure feeders has a driving mechanism comprising at least two driving belts disposed on opposite sides of the predetermined path for driving the items via friction, and wherein the driving belts have openings for applying air pressure on the items in order to change the friction.

The air pressure can be negative or positive air pressure, or a combination of positive air pressure on one driving belt and negative air pressure on another driving belt.

According to the second aspect of the present invention, a driving mechanism for use in a mailing machine, wherein the driving mechanism comprises:

at least two driving belts, disposed on opposite sides of a predetermined path in the mailing machine, for causing mail-related items to move via friction along the predetermined path;

a sensing mechanism positioned relative to the predetermined path for detecting a skew in the items when the items are caused to move by the driving belts; and an air pressure system for applying air pressure to the items to correct the skew if the skew exceeds a predetermined value.

Preferably, the driving belts have a plurality of openings so as to allow the air pressure to be applied on the items for changing the friction.

Preferably, the sensing mechanism comprises at least two photosensors for detecting arrival of the leading edge of items in order to determine whether the skew exceeds the predetermined value.

According to the third aspect of the present invention, there is provided a mail inserter, which comprises:

at least one feeder for releasing mail-related items for mail insertion, wherein the feeder comprises a driving mechanism for causing the items to move along a predetermined path;

a sensing mechanism positioned relative to the driving mechanism for detecting a skew in the items while the items are caused to move by the driving mechanism; and an air pressure system for applying air pressure on the items for correcting the skew if the skew exceeds a predetermined value.

Preferably, the driving mechanism comprises at least two driving belts disposed on opposite sides of the predetermined path for driving the items via friction, said mail inserter further comprising:

a plurality of air conduits operatively connected to the air pressure system and the openings on the driving belts; and a plurality of air valves disposed on the air conduits to control the air pressure applied on the items for correcting the skew.

According to the fourth aspect of the present invention, a movement control system for use in a mailing machine, wherein the mailing machine comprises a driving mechanism for moving mail-related items along a predetermined path. The control system comprises:

a sensing mechanism, positioned relative to the predetermined path, for detecting a skew of the items in the predetermined path; and an air pressure system, operatively engaged with the driving mechanism, for applying air pressure on the items in order to correct the skew if the skew exceeds a predetermined value.

Preferably, the driving mechanism comprises at least two driving belts disposed on opposite sides of the predetermined path for driving the mail-related items via friction, the driving belts having a plurality of openings, and wherein the air pressure system comprises:

a plurality of air conduits operatively connected to the openings on the driving belts; and a plurality of air valves disposed on the air conduits to control the air pressure applied on the items for changing the friction.

The present invention will become apparent upon reading the description taken in conjunction with FIGS. 1 to 5.

BEST MODE FOR CARRYING OUT THE INVENTION

Figure 1:
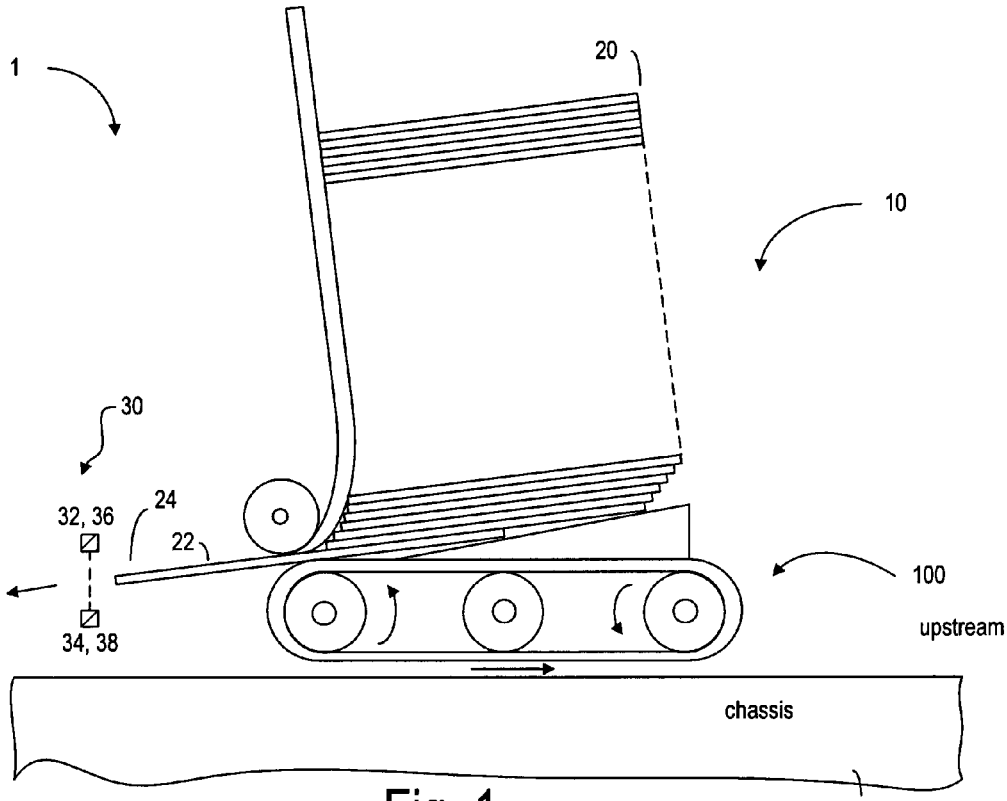
FIG. 1 is a schematic representation showing an enclosure feeder having a feeding mechanism for releasing an enclosure from the bottom of a stack of enclosure material.
Figure 2:
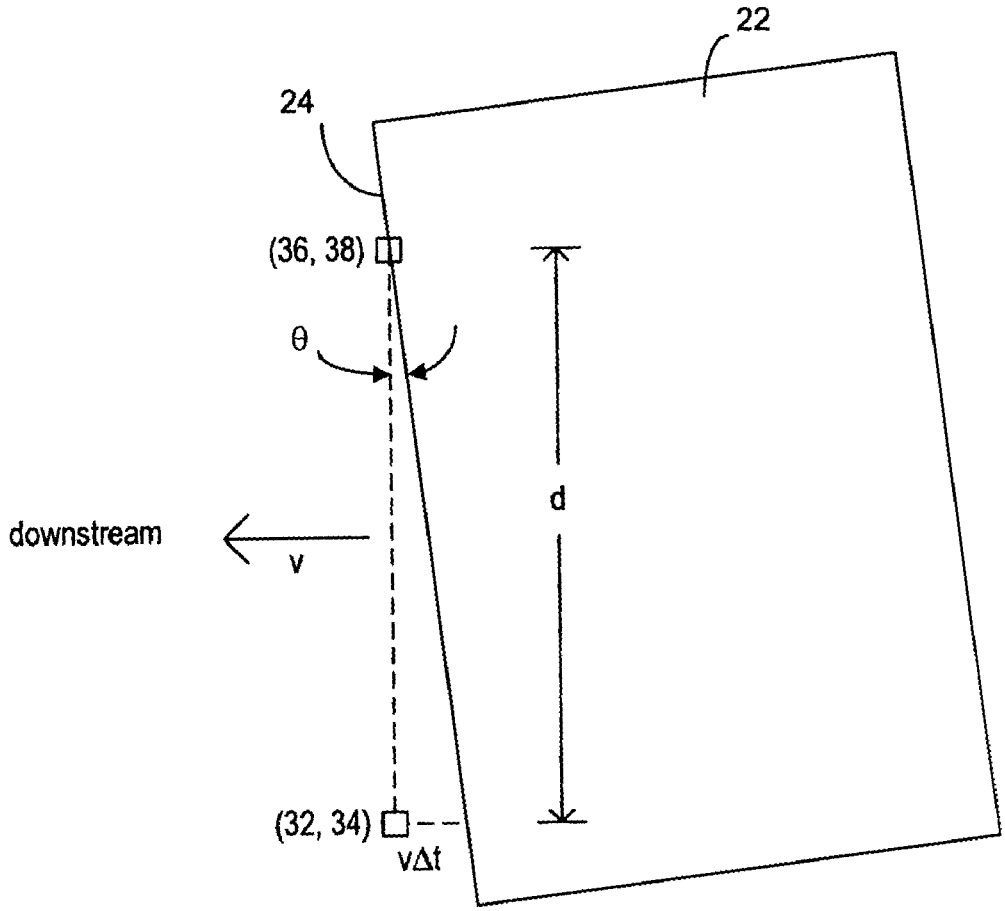
FIG. 2 is a schematic representation showing how the skew angle of the leading edge of a released document is determined.

In order to achieve even feeding in an enclosure feeder in a mail inserter, the present invention uses two or more pairs of photosensors to determine whether the feed is skewed. As shown in FIG. 1, the enclosure feeder 10 has a driving mechanism 100 to release an enclosure document 22, one at a time from the bottom of a stack 20. The released document is released to the chassis 8 to be carried downstream. A photosensing module 30 comprising light emitters 32, 36 and light detectors 34, 38 is used to sense the arrival of the leading edge 24 of the document 22. The arrival of the leading edge 24 is detected when it blocks light produced by a light emitter from reaching the respective light detector. Preferably, photosensing module 30 is arranged such that if the feed is even, the leading edge 24 of the released document 22 blocks the light emitter/detector pairs (32, 34) (36, 38) substantially at the same time. But if the released document 22 is fed unevenly and it is skewed to the left such that the right side of the leading edge 24 moves slightly ahead of the left side, then the light emitter/detector pair (36, 38) is blocked sooner than the light emitter/detector pair (32, 34) is blocked. When the moving speed of the released document v, the arrival time difference $\Delta t$ of the leading edge at the light emitter/detector pairs, and the distance d between the light/detector pairs are known, the skew angle $\theta=(v\Delta t/d)$ can be easily determined. The position of the light emitter/detector pairs (32, 34) (36, 38) is fixed relative to the feeder allowing direct measurement of the linear distance traveled by the enclosure. Based on the separation spacing of the photocells and the lag of one side of the enclosure behind the other, the skew angle is calculated as the arctan of those values (lag divided by photocell separation). The skew angle is illustrated in FIG. 2.

Figure 3:
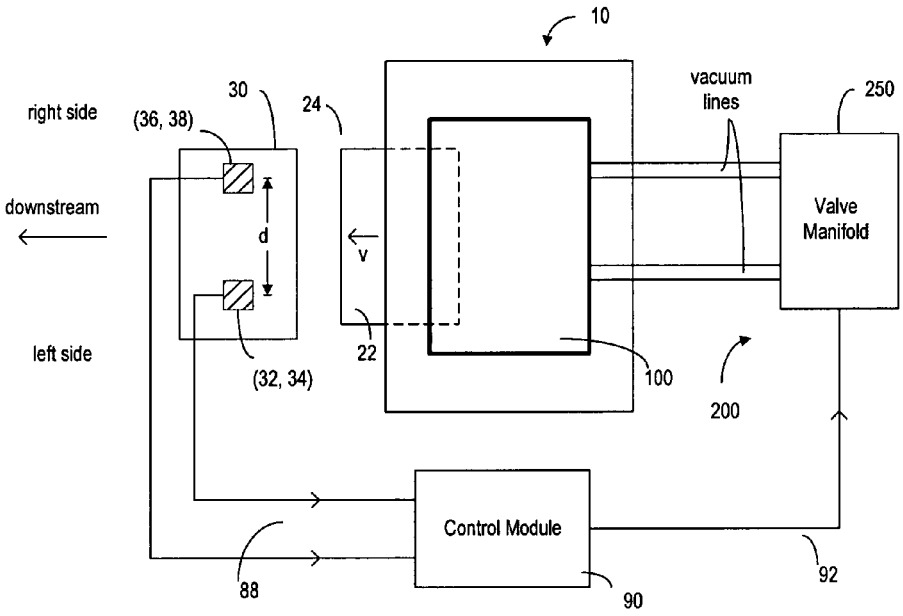
FIG. 3 is a schematic representation showing the system for controlling the enclosure feeder.

In order to determine the skew angle of the arriving enclosure document 22 and to straighten the moving path of subsequent enclosure documents, the sensing signals 88 from the photosensing module 30 are conveyed to a control module 90, as shown in FIG. 3. Based on the signals 88, the control module 90 determines whether the skew angle $\theta$ resulting from uneven feeding must be corrected.

It should be noted that the enclosure documents in a stack are usually identical to each other. However, the friction between one side of the enclosure document and the driving mechanism may be different from the friction between the other side of the enclosure document and the driving mechanism. For example, one side of the enclosure document may be printed with a picture while the other side printed with text, the side with the picture may have less friction than the other side. As a result, the leading edge of the "picture" side may trail behind the leading edge of the other side. Preferably, an air pressure, negative or positive, is used to equalize the friction on both sides of the enclosure document.

Figure 4:
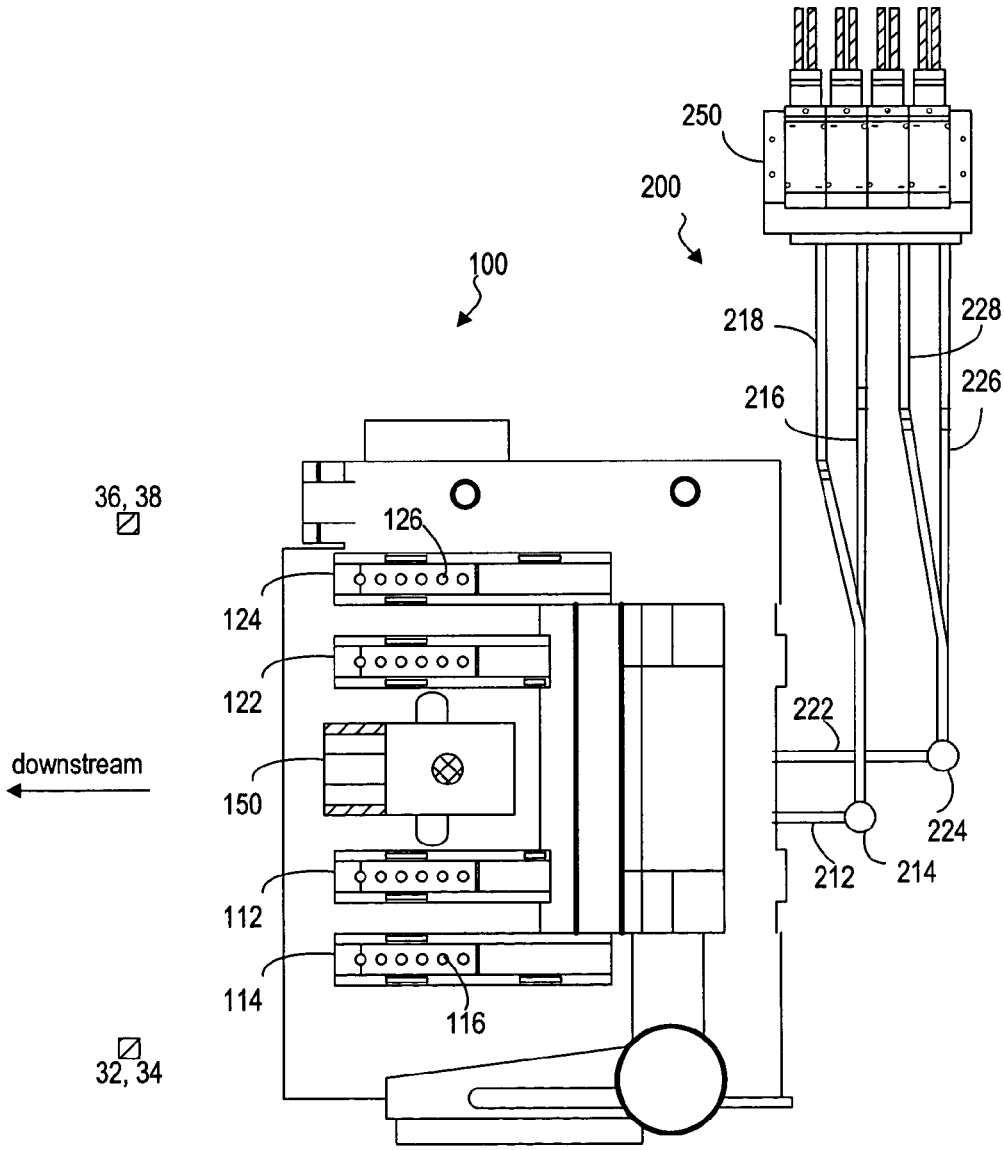
FIG. 4 is a top view showing the enclosure driving mechanism and the photosensors disposed downstream from the driving mechanism.
Figure 5:
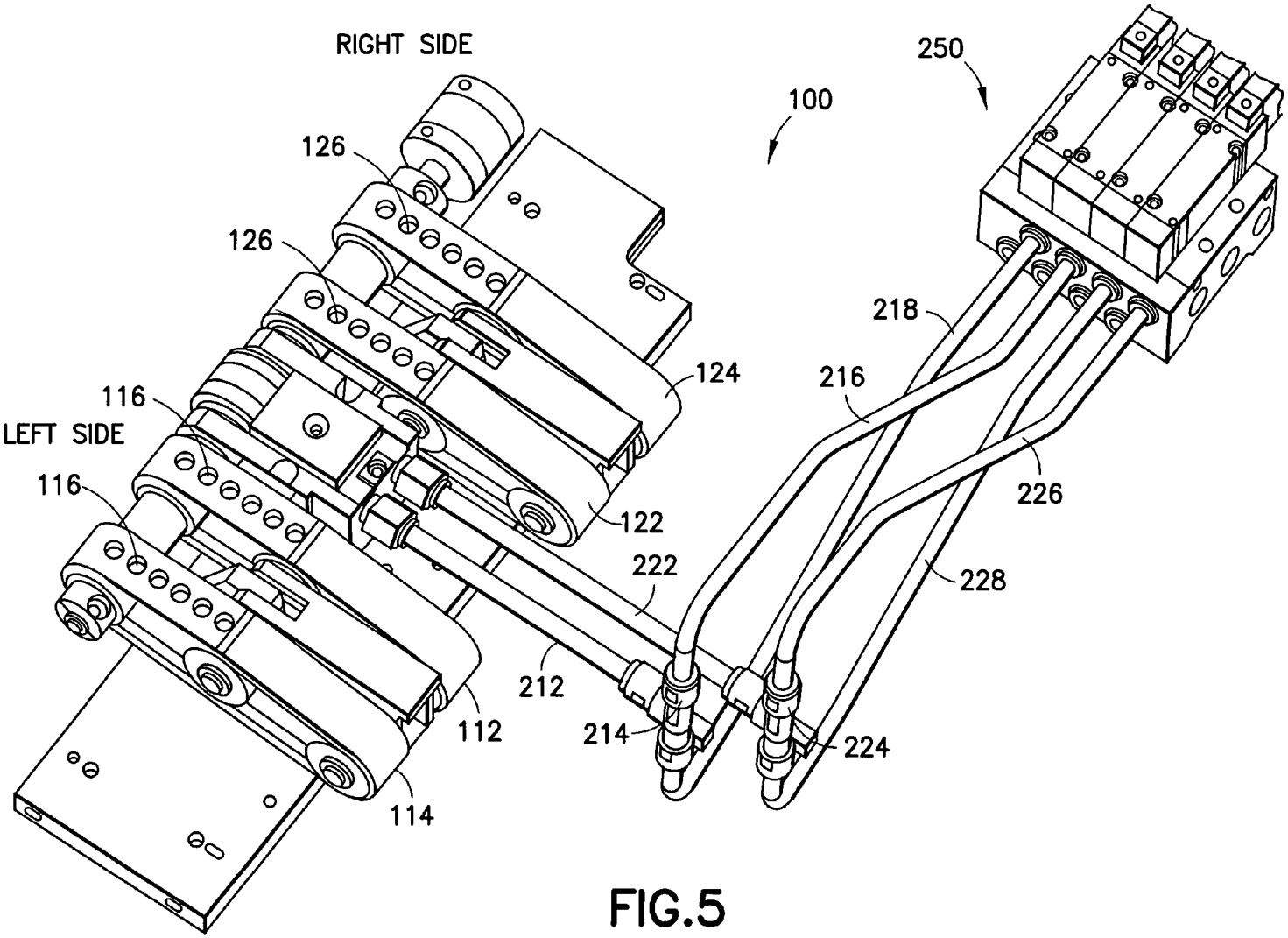
FIG. 5 is an isometric view of a vacuum feeder assembly, along with the driving mechanism of the enclosure feeder.

According to the present invention, a valve manifold 250 of a vacuum system 200 is used to create such a friction force adjustment to the driving mechanism 100. As shown in FIG. 3, the valve manifold 250 is operatively connected to the control module 90 so as to allow the control module 90 to change the friction in the driving mechanism 100. In particular, when the driving mechanism 100 comprises a plurality of feed belts 112, 114 on its left side and feed belts 122, 124 of the right side, it is preferable to alter the normal force of the feed belts in order to create even drive on the right and left side of the enclosure documents. As shown in FIGS. 4 and 5, the feed belts 112 and 114 have opening 116 and the feed belts 122 and 124 have opening 126. The openings 116 are operatively connected to the valve manifold 250 by a vacuum line 212, which is further connected to a pressure supply line 216 and an exhaust line 218 via a pneumatic venturi 214. Similarly, the openings 126 are operatively connected to the valve manifold 250 by a vacuum line 222, which is further connected to a pressure supply line 226 and an exhaust line 228 via a pneumatic venturi 224. As such, a positive pressure or negative pressure can be selectively applied in different combinations to the left, right, or both sides of the enclosure document that is driven by the feed belts. For example, if a negative vacuum force is applied to the right side of the enclosure document through the openings 126 as the enclosure document is driven by the driving mechanism 100, the slippage between the feed belts 122, 124 and the enclosure document can be reduced. However, the same effect can be achieved by applying a positive vacuum force to the left side of the enclosure document through the openings 116 in order to reduce the friction between the feed belts 112, 114 and the enclosure document. The positive air pressure that is used to reduce the normal force on the feed belts is the result of positive air pressure introduced through an exhaust line. The negative air pressure that is used to increase the normal force on the feed belts is the result of pressurized air passed through a venturi, for example. With separate pressure supply lines and exhaust lines, it is possible to increase the friction on one side of the enclosure document while decreasing the friction on the other side of the enclosure document. Advantageously, a feed roller 150 is also provided to feed the enclosure documents.

Preferably, the vacuum port of the pneumatic venturi is connected to a manifold below the feed belts to transmit a difference of air pressure through the feed belts. The exhaust of the venturi can be fed though a valve, which when shifted, pressurizes the manifold below the feed belts. The mechanism is present on both sides of the driving mechanism, allowing left and right hand control of the drive.

Preferably, when the control module senses the skew of the enclosure documents departing the driving mechanism, it checks the skew against an error threshold. If the skew exceeds the error threshold, it sends a control signal 92 to the valve manifold in order to activate the corrective system. For example, if the right side of an enclosure document leads the left side, an increase in the friction at the belt-enclosure interface on the left side is necessary to reduce the slippage. But it is also possible to reduce the friction at the interface on the right side separately or concurrently. This can be accomplished by activating the vacuum on the left side and blocking or pressuring the pneumatic venturi exhaust on the right side. The opposite skew can be controlled conversely. When the skew is below the error threshold, the driving mechanism may be able to return to normal operation. The error threshold, can be set between 5 to 15 degrees, for example.

In sum, positive pressure or negative pressure can be applied only on one side of the driving mechanism to correct for the skew of enclosure documents. However, opposite pressures can also be concurrently applied to the enclosure documents. As shown in FIGS. 4 and 5, two feed belts are provided on each side of the driving mechanism 100. However, it is possible to have only one feed belt or more than two feed belts on each side of the driving mechanism. Furthermore, it is also possible to have one vacuum line for each feed belt to correct the skewed feed of enclosure documents. The corrective system can be deactivated when no skew problems are detected by the control module. The present invention broadens the range of enclosure material to be handled and enables automatic control of the corrections. The present invention is particularly useful in handling enclosure materials that have difficult and unique friction characteristics and exhibit a tendency to feed unevenly.

It should be noted that the present invention has been described in conjunction with an enclosure feeder. However, the same principle can also be applied to an envelope feeder in a mail inserting machine or the like.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A method for correcting movement of a plurality of serially fed flat items in a mailing machine, said method comprising the steps of:

frictionally driving the flat items along a predetermined path, the predetermined path comprised of first and second parallel portions along a length of the path, the first and second parallel portions providing parallel frictional driving forces to the flat items;

detecting a skew of the items in the predetermined path, the skew being characterized such that an item is positioned so that a leading edge of the item is tilted relative to the path and the leading edge in the first parallel portion of the path is ahead of the leading edge in the second parallel portion of the path, and reducing the skew if the skew exceeds a predetermined value by applying differing air pressure from the first or second parallel portions of the path to the skewed item, the differing air pressure acting to alter relative frictional forces on the skewed item from the first and second parallel portions.

2. The method of claim 1 further comprising the steps of disposing a first sensor in the first parallel portion of the predetermined path for sensing the leading edge of the item in a region of the first parallel portion;

disposing a second sensor in the second parallel portion of the predetermined path for sensing the leading edge of the item in a region of the second parallel portion; and wherein the step of detecting the skew includes comparing a position of the leading edge detected by the first sensor with a position of the leading edge detected by the second sensor.

3. The method of claim 1 wherein the step of reducing the skew includes applying a positive air pressure from the first parallel portion to the item to reduce the skew, the positive air pressure acting to reduce frictional forces between the first parallel portion and the item.

4. The method of claim 1 wherein the step of reducing the skew-includes applying a negative air pressure from the second parallel portion to the item to reduce the skew, the negative air pressure acting to increase frictional forces between the second parallel portion and the item.

5. The method of claim 4 wherein the step of reducing the skew further includes applying a positive air pressure from the first parallel portion to the item to reduce the skew, the positive air pressure acting to reduce frictional forces between the first parallel portion and the item.

6. The method of claim 1 wherein depending on a magnitude of the detected skew the step of applying differing air pressure consists of one of (a) applying positive air pressure only from the first parallel portion to the item, the positive air pressure acting to decrease frictional forces between the first parallel portion and the item, (b) applying negative air pressure only from the second parallel portion to the item, the negative air pressure acting to increase frictional forces between the second parallel portion and the item, or (c) simultaneously applying positive air pressure from the first parallel portion and applying negative air pressure from the second parallel portion.

7. The method of claim 1 including a step of releasing the items one at a time onto the predetermined path from above the predetermined path.

8. The method of claim 2, wherein the step of detecting the skew includes detecting an interruption of a light path by the item's lead edge.

9. The method of claim 1, wherein the step of frictionally driving includes positioning at least two driving belts on opposite sides of the predetermined path for driving the items via friction, and the step of reducing the skew includes applying air pressure on the items in order to change the friction through openings in the belts.

10. The method of claim 9, wherein the step of applying air pressure includes applying negative air pressure.

11. The method of claim 9, wherein the step of applying air pressure includes applying positive air pressure.

12. The method of claim 9, wherein the step of applying air pressure includes a combination of applying positive air pressure through the openings on one of the driving belts and negative air pressure through the openings of the other of the driving belts.

* * * * *